US011612984B2

(12) United States Patent
Yin et al.

(10) Patent No.: US 11,612,984 B2
(45) Date of Patent: Mar. 28, 2023

(54) DEVICE FOR TARGETED REPAIR OF MICRO-NANO DAMAGE OF INNER RING OF AEROENGINE BEARING AND METHOD FOR TARGETED REPAIR OF MICRO-NANO DAMAGE OF AEROENGINE BEARING BASED ON ELECTRIC-MAGNETIC COMPOSITE FIELD

(71) Applicant: WUHAN UNIVERSITY OF TECHNOLOGY, Hubei (CN)

(72) Inventors: Fei Yin, Hubei (CN); Lin Hua, Hubei (CN); Chang Yang, Hubei (CN)

(73) Assignee: WUHAN UNIVERSITY OF TECHNOLOGY, Hubei (CN)

( * ) Notice: Subject to any disclaimer, the term of this patent is extended or adjusted under 35 U.S.C. 154(b) by 0 days.

(21) Appl. No.: 17/738,029

(22) Filed: May 6, 2022

(65) Prior Publication Data

US 2022/0355442 A1 Nov. 10, 2022

(30) Foreign Application Priority Data

May 6, 2021 (CN) ..... 202110490617.6

(51) Int. Cl.
*B24C 1/10* (2006.01)
*B24C 5/00* (2006.01)
(Continued)

(52) U.S. Cl.
CPC ..... *B24C 1/10* (2013.01); *B24C 5/005* (2013.01); *B24C 5/08* (2013.01); *F01D 25/16* (2013.01);
(Continued)

(58) Field of Classification Search
CPC ..... B21D 31/06; B21D 24/16; B24C 1/10; B24C 5/005; B24C 5/08; B24B 39/006; C21D 7/06
See application file for complete search history.

(56) References Cited

U.S. PATENT DOCUMENTS 3,212,311 A * 10/1965 Inoue ..... B29C 35/08 264/479
5,813,265 A * 9/1998 Shaw ..... C21D 10/00 72/707

(Continued)

FOREIGN PATENT DOCUMENTS

WO 93/20247 A1 * 10/1993 ..... C21D 7/06

*Primary Examiner* — Edward T Tolan
(74) *Attorney, Agent, or Firm* — JCIPRNET

(57) ABSTRACT

A device for targeted repair of micro-nano damage of an inner ring of an aeroengine bearing by an electric-magnetic composite field includes a driving device, an ultrasonic shot peening device, a pulsed current generator and a magnet yoke-coil device. The driving device includes a motor and a rotating shaft. The motor drives the rotating shaft to drive a bearing inner ring to synchronously rotate. The ultrasonic shot peening device includes an ultrasonic shot peening cavity, an ultrasonic probe and steel balls, the ultrasonic probe extends into the cavity from an opening in a lower end of the cavity, and the steel balls are placed on the ultrasonic probe. An opening in an upper end of the cavity is placed below the bearing inner ring. The pulsed current generator generates pulsed current on the bearing inner ring. The magnet yoke-coil device can excite a magnetic field around the bearing inner ring.

10 Claims, 4 Drawing Sheets

(51) Int. Cl.
*B24C 5/08* (2006.01)
*F01D 25/16* (2006.01)

(52) U.S. Cl.
CPC ..... *F05D 2230/80* (2013.01); *F05D 2230/90* (2013.01); *F05D 2240/50* (2013.01)

(56) References Cited

U.S. PATENT DOCUMENTS

| | | | | |
|---|---|---|---|---|
| 5,950,470 | A * | 9/1999 | Prewo | B24B 31/006 72/430 |
| 7,028,378 | B2 * | 4/2006 | Cheppe | B24B 39/006 29/90.7 |
| 7,647,801 | B2 * | 1/2010 | Cheppe | C21D 7/06 451/39 |
| 10,882,159 | B2 * | 1/2021 | Cheng | B24C 7/0069 |
| 2011/0030434 | A1 * | 2/2011 | Viguera Sancho | B24C 1/10 72/53 |
| 2011/0179843 | A1 * | 7/2011 | Ventzke | C21D 9/40 72/53 |
| 2013/0273394 | A1 * | 10/2013 | Sheu | B21B 1/227 72/199 |
| 2014/0373585 | A1 * | 12/2014 | Ache | C21D 9/14 72/53 |

* cited by examiner

DEVICE FOR TARGETED REPAIR OF MICRO-NANO DAMAGE OF INNER RING OF AEROENGINE BEARING AND METHOD FOR TARGETED REPAIR OF MICRO-NANO DAMAGE OF AEROENGINE BEARING BASED ON ELECTRIC-MAGNETIC COMPOSITE FIELD

CROSS-REFERENCE TO RELATED APPLICATION

This application claims the priority benefit of China application serial no. 202110490617.6, filed on May 6, 2021. The entirety of the above-mentioned patent application is hereby incorporated by reference herein and made a part of this specification.

BACKGROUND

Technical Field

The present invention relates to the technical field of workpiece surface nano strengthening tools, in particular to a device and method for targeted repair of micro-nano damage of an inner ring of an aeroengine bearing by virtue of an electric-magnetic composite field.

Description of Related Art

An aeroengine bearing is a core component of an aeroengine, and due to the fact that the aeroengine bearing bears extreme working conditions and is complex in manufacturing process, extremely high service performance and service life guarantee of the aeroengine bearing are leading challenges in the manufacturing field. The research shows that the main failure form of the aeroengine bearing is surface damage and fracture, and it is difficult to realize the transformative improvement of the surface and matrix performance of the raceway of the aeroengine bearing by the existing forming and heat treatment processes. It is an international problem restricting manufacturing of the high-performance aeroengine bearing that the performance and the service life of the aeroengine bearing reach the limit and are difficult to break through.

The present invention provides a novel method for repairing micro-nano damage of an ultra-limit performance matrix of an aeroengine bearing by virtue of an electric-magnetic composite field. Based on the micro-area deformation and phase change effect under the electromagnetic energy transfer coupling effect, targeted regulation and control are conducted on an aeroengine bearing matrix damage micro-area, deformation and phase change and internal energy distribution are homogenized, damage defects are repaired in situ, a weak structure property area is strengthened in a targeted mode, and the problem of matrix micro-nano scale damage defect control in macro-scale manufacturing is solved. The present invention relates to an innovative technology of "micro-nano damage targeted repair" of an aeroengine bearing, which breaks through the service performance and service life limits of the existing aeroengine bearing.

SUMMARY

The present invention aims to solve the technical problem that the micro-nano scale damage defect of a matrix is difficult to control in the macro-scale manufacturing (such as shot peening) of a bearing ring machined at present, and provides a device and method for targeted repair of micro-nano damage of an inner ring of an aeroengine bearing by virtue of an electric-magnetic composite field. In-situ surface micro-nano damage formed during the ultrasonic impact surface nanocrystallization or after the ultrasonic impact surface nanocrystallization is repaired, so that deformation, phase change and internal energy distribution of a nanolayer are homogenized, the problem of matrix micro-nano scale damage defect control in macroscale manufacturing is solved, and the service performance and service life limits of an existing aeroengine bearing are broken through.

In order to solve the technical problem, the technical solution adopted by the present invention is as follows:

A device for targeted repair of micro-nano damage of an inner ring of an aeroengine bearing by virtue of an electric-magnetic composite field comprises a driving device, an ultrasonic shot peening device, a pulsed current generator and a magnet yoke-coil device. The driving device comprises a motor and a rotating shaft, the rotating shaft is configured for fixedly installing a bearing inner ring to be machined, and an output shaft of the motor is connected to the rotating shaft and drives the rotating shaft to drive the bearing inner ring to rotate synchronously. The ultrasonic shot peening device comprises an ultrasonic shot peening cavity, an ultrasonic probe and steel balls, openings are formed in the upper end and the lower end of the ultrasonic shot peening cavity, the ultrasonic probe extends into the ultrasonic shot peening cavity from the opening in the lower end of the ultrasonic shot peening cavity, and the steel balls are placed on the ultrasonic probe and cover an upper surface of the ultrasonic probe. The opening in the upper end of the ultrasonic shot peening cavity is placed below and in clearance fit with the bearing inner ring to be machined. Ultrasonic impact surface nanometer strengthening can be carried out on the bearing inner ring by separately starting the ultrasonic probe and the motor.

An input-end contact and an output-end contact of the pulsed current generator are in contact with two ends of the bearing inner ring respectively and are configured for generating pulsed current on the bearing inner ring.

The magnet yoke-coil device comprises a magnet yoke plate and a current-carrying coil wound around the magnet yoke plate, the magnet yoke plate is installed on the side of the bearing inner ring, and the current-carrying coil is configured for being connected with the pulsed current so as to excite a magnetic field around the bearing inner ring.

According to the above solution, the driving device is integrally installed on a first lifting frame, and the gap between the bearing inner ring and the opening in the upper end of the ultrasonic shot peening cavity is adjusted through the first lifting frame.

According to the above solution, the ultrasonic shot peening cavity is installed on a fixing support, the ultrasonic probe is installed on a second lifting frame, and a distance between the upper surface of the ultrasonic probe and a raceway of the bearing inner ring is adjusted through the second lifting frame.

According to the above solution, the opening in the upper end of the ultrasonic shot peening cavity is designed to be in a cambered surface shape matched with a radian of the raceway of the bearing inner ring, so as to realize tight fit between the raceway of the bearing inner ring and the ultrasonic shot peening cavity and prevent the steel balls from being sputtered out in an impact process.

According to the above solution, a number of the magnet yoke plates is two, the two magnet yoke plates are respectively arranged on two sides of the bearing inner ring in parallel to cover the bearing inner ring, and the current-carrying coil is wound around the two magnet yoke plates and located above the bearing inner ring.

According to the above solution, the ultrasonic shot peening device adopts high-frequency ultrasonic waves with a frequency of 20 KHz-10000 KHz. A diameter of the steel ball is 0.1 mm-10 mm, a number of the steel balls is 10-1000, and an ultrasonic treatment time is 10 s-1200 s.

In the above solution, the electric pulse intensity range of the pulsed current generator is $1\text{-}10^6$ A/cm$^2$.

In the above solution, the magnetic pulse intensity range of the magnet yoke-coil device is 0.01-100 Tesla.

Correspondingly, the present invention further provides a method for targeted repair of micro-nano damage of an aeroengine bearing by virtue of an electric-magnetic composite field, and the method is carried out by adopting the device and comprises the following steps.

S1. Preparing the driving device and the ultrasonic shot peening device which are matched with a selected aeroengine bearing according to a model of the selected aeroengine bearing, and preparing the pulsed current generator and a set of the magnet yoke-coil device.

S2. Installation and adjustment of equipment: installing the ultrasonic shot peening cavity on a fixing support, then integrally installing the driving device on a first lifting frame, and enabling the opening in the upper end of the ultrasonic shot peening cavity to be located right below the bearing inner ring; finally, installing the ultrasonic probe on a second lifting frame, covering the upper surface of the ultrasonic probe with steel balls, and feeding the ultrasonic probe into the ultrasonic shot peening cavity; adjusting a gap between the bearing inner ring and the opening in the upper end of the ultrasonic shot peening cavity to a set value through the first lifting frame, and adjusting a distance between the upper surface of the ultrasonic probe and a raceway of the bearing inner ring to a set value through the second lifting frame.

Winding the current-carrying coil around the magnet yoke plates, and then enabling the magnet yoke plates around which the current-carrying coil is wound to cover the bearing inner ring needing shot peening.

Enabling the input-end contact and the output-end contact of the pulsed current generator to be in contact with the two ends of the bearing inner ring respectively, and forming a loop by taking the bearing inner ring as a conductor.

S3. Electrifying the current-carrying coil to excite the magnetic field; electrifying the pulsed current generator to generate the pulsed current on the bearing inner ring to excite an electric field; then starting the motor to enable the bearing inner ring to rotate, and starting the ultrasonic shot peening device to enable the ultrasonic probe to generate high-frequency vibration to excite the steel balls in the ultrasonic shot peening cavity to impact a surface of the raceway of the bearing inner ring at a higher speed.

Correspondingly, the present invention further provides a method for targeted repair of micro-nano damage of an aeroengine bearing by virtue of an electric-magnetic composite field, and the method is carried out by adopting the device and comprises the following steps:

S1. Preparing the driving device and the ultrasonic shot peening device which are matched with a selected aeroengine bearing according to a model of the selected aeroengine bearing, and preparing the pulsed current generator and a set of the magnet yoke-coil device.

S2. Installation and adjustment of equipment: installing the ultrasonic shot peening cavity on a fixing support, then integrally installing the driving device on a first lifting frame, and enabling the opening in the upper end of the ultrasonic shot peening cavity to be located right below the bearing inner ring; finally, installing the ultrasonic probe on a second lifting frame, covering the upper surface of the ultrasonic probe with steel balls, and feeding the ultrasonic probe into the ultrasonic shot peening cavity; adjusting a gap between the bearing inner ring and the opening in the upper end of the ultrasonic shot peening cavity to a set value through the first lifting frame, and adjusting a distance between the upper surface of the ultrasonic probe and a raceway of the bearing inner ring to a set value through the second lifting frame.

Winding the current-carrying coil around the magnet yoke plates, and then enabling the magnet yoke plates around which the current-carrying coil is wound to cover the bearing inner ring needing shot peening.

Enabling the input-end contact and the output-end contact of the pulsed current generator to be in contact with the two ends of the bearing inner ring respectively, and forming a loop by taking the bearing inner ring as a conductor.

S3. Starting the motor to enable the bearing inner ring to rotate, and starting the ultrasonic shot peening device to enable the ultrasonic probe to generate high-frequency vibration to excite the steel balls in the ultrasonic shot peening cavity to impact a surface of the raceway of the bearing inner ring at a higher speed to enable severe plastic deformation to be generated on the surface of the raceway of the aeroengine bearing inner ring, so as to realize nanometer strengthening of the surface of the raceway of the aeroengine bearing.

S4. Closing the ultrasonic probe, stopping ultrasonic shot peening, and keeping the bearing inner ring rotating; then electrifying the current-carrying coil to excite the magnetic field; electrifying the pulsed current generator to generate the pulsed current on the bearing inner ring to excite an electric field; and performing targeted repair on the micro-nano damage of the bearing inner ring under an action of the electric-magnetic composite field.

The beneficial effects of the present invention lie in that:

1. A high-frequency ultrasonic signal is adopted to excite the steel balls to impact the surface of the raceway of the aeroengine bearing inner ring, and shot peening enables the raceway of the bearing inner ring to generate severe plastic deformation, thus resulting in the increase of the dislocation density, grain refinement and the formation of a nanometer strengthening layer, so that the surface hardness and abrasion resistance of the working surface of a bearing ring are improved, the fatigue life of the working surface of the bearing ring is prolonged, and the service performance and the service life limits of the existing aeroengine bearing are broken through.

2. The tool which can be adjusted up and down and is installed in a split manner is adopted, so that the problem that ultrasonic shot peening is not suitable for bearing manufacturing due to limitation of generation, a vibration device and the shot peening direction is solved, the cambered-surface cavity is adopted to realize precise clearance fit with the raceway of the bearing inner ring, variable-speed rotation is realized by adopting the speed-adjustable motor, and the shot peening distance can be adjusted up and down, so that the process parameters are adjustable, and ultrasonic impact is successfully applied to the inner ring of the aeroengine bearing, so that a surface nano layer with a certain thickness is generated on the surface of the raceway of the bearing inner ring.

3. The driving device is integrally installed on the first lifting frame, and the gap between the bearing inner ring and the opening in the upper end of the ultrasonic shot peening cavity is adjusted through the first lifting frame, so that not only can tight clearance fit between the bearing inner ring and the ultrasonic shot peening cavity be ensured, but also the bearing inner ring can rotate at a high speed without interference; meanwhile, the ultrasonic probe is installed on the second lifting frame, the distance between the upper surface of the ultrasonic probe and the raceway of the bearing inner ring is adjusted through the second lifting frame, so that the shot peening distance is controllable, and the optimal surface nanometer strengthening effect is achieved for bearings made of different materials.

4. The surface of the ultrasonic probe is covered with the steel balls, the ultrasonic probe generates high-frequency vibration to endow the steel balls on the ultrasonic probe with high-frequency and high-speed impact energy for ultrasonic shot peening, a part of area can be directly treated, and compared with an ultrasonic rolling or ultrasonic dot matrix method, when the same area is treated at the same time, the present invention is shorter in treatment time and higher in efficiency.

5. The pulsed current and the pulsed magnetic field are applied to the bearing inner ring at the same time to form an electric-magnetic composite field, the energy state of valence electrons is changed by externally applying the electric field and the magnetic field, then high-energy-state atoms are promoted to move to a new balance position, and free energy of the system is reduced; the magnetic field provides power, the current plays a lubricating role, and the composite treatment by the coupled pulsed magnetic field and pulsed current has a gain effect on reducing the residual stress; the electric-magnetic composite field can improve microcosmic non-uniformity, homogenize deformation, phase change and internal energy distribution, repair damage defects in situ and strengthen a weak structure property area in a targeted manner on the basis of ultrasonic impact surface strengthening, the problem of matrix micro-nano scale damage defect control in macroscale manufacturing is solved, and the fatigue life of an existing aeroengine bearing is further prolonged.

6. The novel technology of ultrasonic impact surface nano-strengthening by virtue of the electric-magnetic composite field is suitable for various metal materials such as aluminum alloy, titanium alloy, stainless steel, nickel-based alloy and carbon steel. The novel technology of ultrasonic impact surface nano-strengthening by virtue of the electric-magnetic composite field is suitable for strengthening inner ring raceways and matrixes of various bearings such as rolling bearings and sliding bearings. The novel technology of ultrasonic impact surface nano-strengthening by virtue of the electric-magnetic composite field can be popularized to surface and matrix structure property strengthening and service life prolonging of other mechanical parts such as motor shafts, gears and blades.

BRIEF DESCRIPTION OF THE DRAWINGS

The present invention will be further explained below in combination with the accompanying drawings and embodiments, in which.

DESCRIPTION OF THE EMBODIMENTS

In order to more clearly understand the technical features, purposes and effects of the present invention, the specific implementations of the present invention will be explained in detail according to the accompanying drawings.

Figure 1:
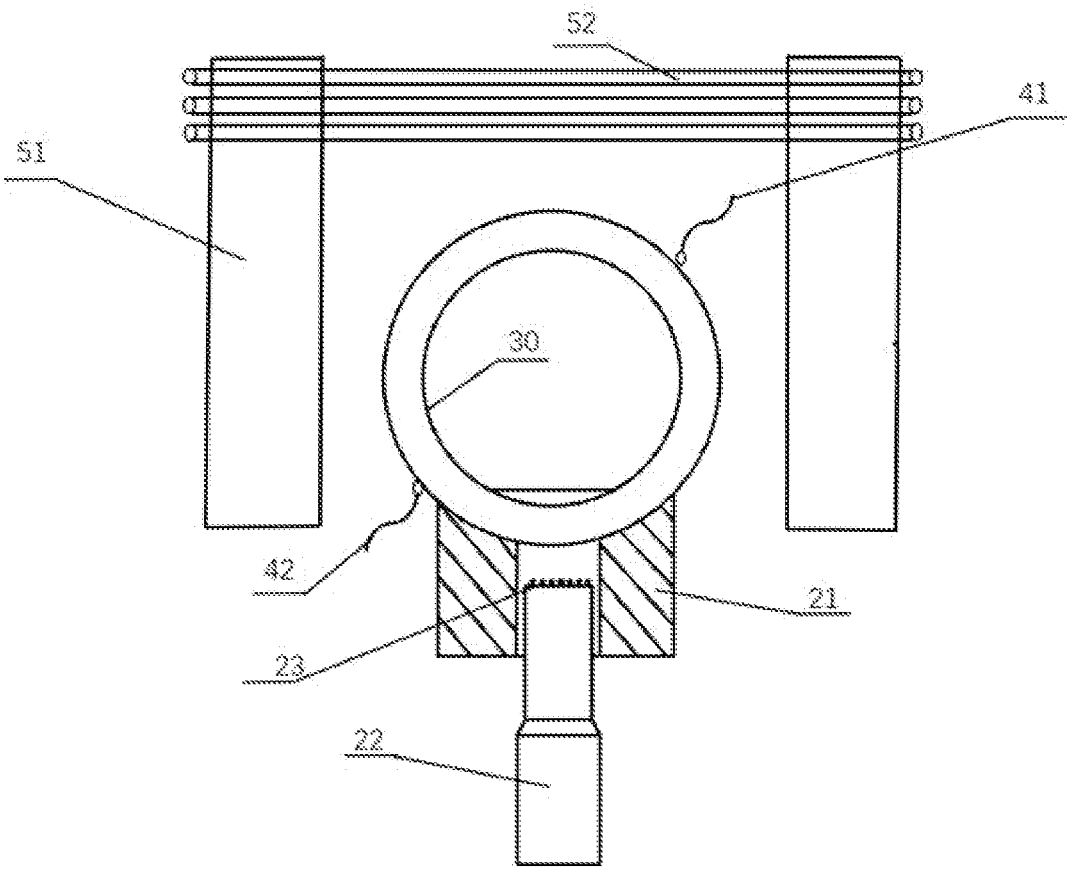
FIG. 1 is a side view of an overall structure of a device for targeted repair of micro-nano damage of an inner ring of an aeroengine bearing by virtue of an electric-magnetic composite field.
Figure 2:
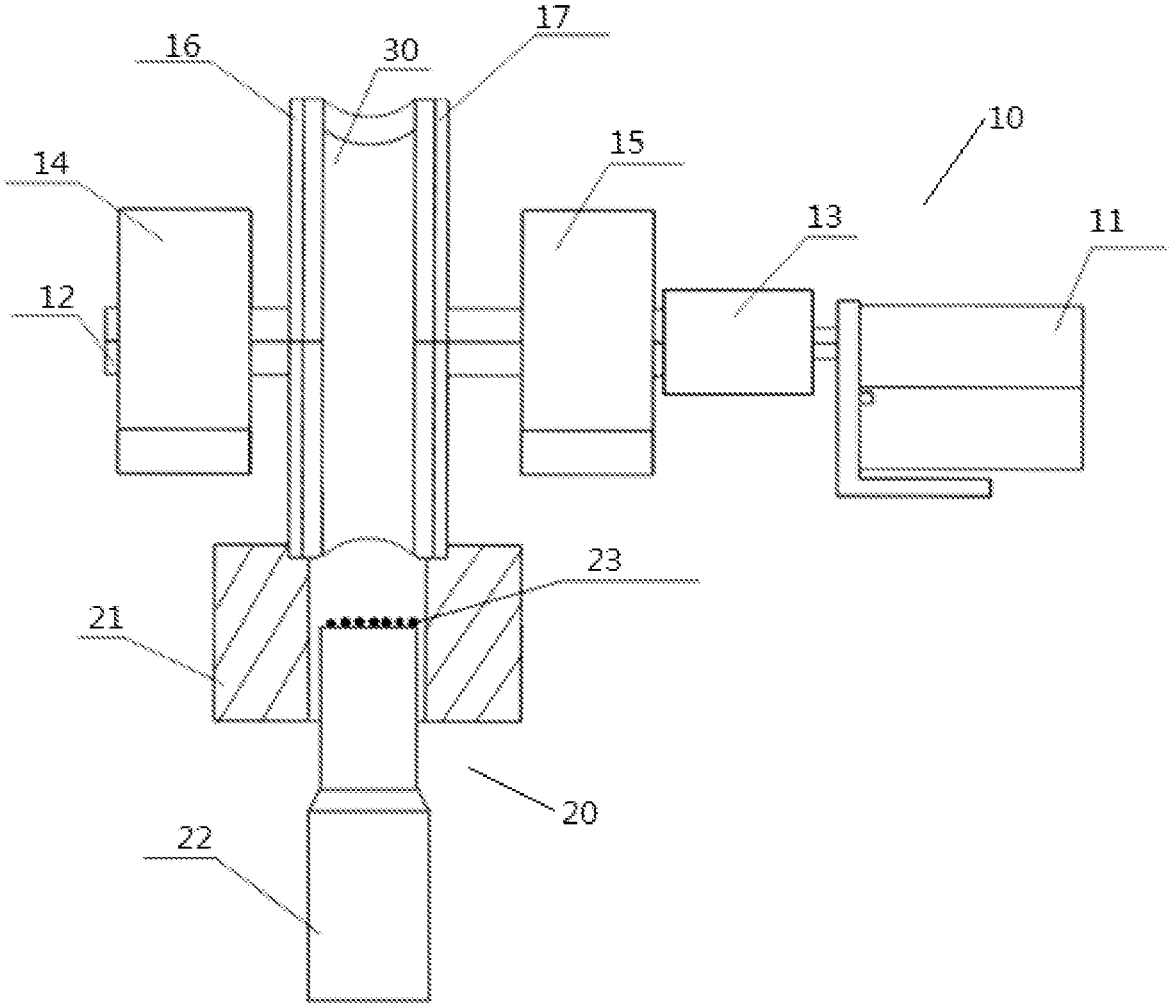
FIG. 2 is a front view of a driving device and an ultrasonic shot peening device of the device shown in FIG. 1.
Figure 3:
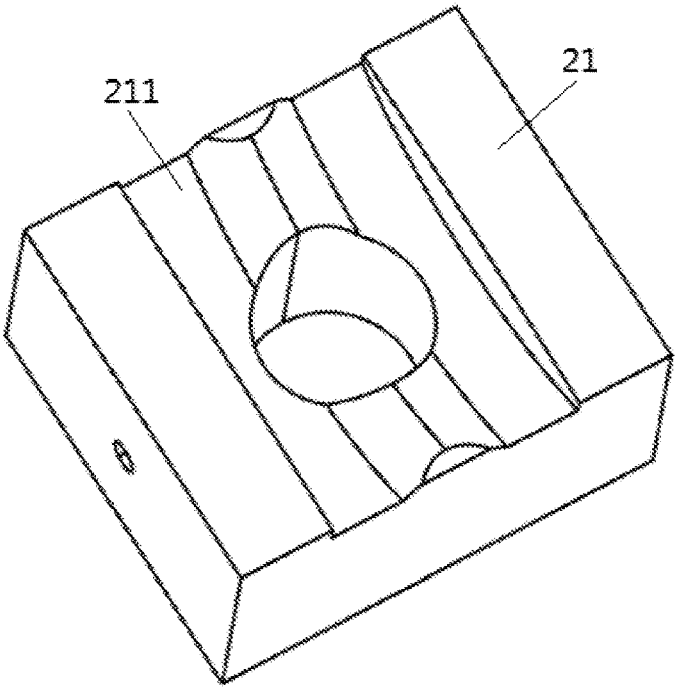
FIG. 3 is a structural schematic diagram of an ultrasonic shot peening cavity of the ultrasonic shot peening device shown in FIG. 2.

As shown in FIG. 1 to FIG. 3, a device for targeted repair of micro-nano damage of an inner ring of an aeroengine bearing by virtue of an electric-magnetic composite field provided by the embodiments of the present invention comprises a driving device 10, an ultrasonic shot peening device 20, a pulsed current generator and a magnet yoke-coil device.

The driving device 10 comprises a motor 11 and a rotating shaft 12. The rotating shaft 12 is used for fixedly installing a bearing inner ring 30 to be machined, and an output shaft of the motor 11 is connected to the rotating shaft 12 through a coupling 13, and drives the rotating shaft 12 to drive the bearing inner ring 30 to rotate synchronously. The ultrasonic shot peening device 20 comprises an ultrasonic shot peening cavity 21, an ultrasonic probe 22 and steel balls 23. Openings are respectively formed in the upper end and the lower end of the ultrasonic shot peening cavity 21, the ultrasonic probe 22 extends into the ultrasonic shot peening cavity 21 from the opening in the lower end of the ultrasonic shot peening cavity, and the steel balls 23 are placed on the ultrasonic probe 22 and cover the upper surface of the ultrasonic probe 22. The opening in the upper end of the ultrasonic shot peening cavity 21 is placed below and in good clearance fit with the bearing inner ring 30 to be machined. The ultrasonic probe 22 and the motor 11 are started separately to drive the bearing inner ring 30 to generate relative movement of rotating and high-frequency impact, and then ultrasonic impact surface nanometer strengthening can be carried out on the bearing inner ring 30.

An input-end contact 41 and an output-end contact 42 of the pulsed current generator are in contact with the two ends of the bearing inner ring respectively.

The magnet yoke-coil device comprises two magnet yoke plates 51 and a current-carrying coil 52 wound around the two magnet yoke plates 51. The two magnet yoke plates 51 are arranged on the two sides of the bearing inner ring in parallel to cover the bearing inner ring, and the current-carrying coil 52 is located above the bearing inner ring. The current-carrying coil 52 is connected with pulsed current, and pulsed magnetic fields of various shapes can be generated by introducing the pulsed current of different waveforms into the current-carrying coil. The magnet yoke adopts two magnet yoke plates, the current-carrying coil is wound around the magnet yoke plates, the magnet yoke restrains leakage flux of the current-carrying coil from outward diffusion, dissipation of a magnetic field is reduced, the magnetic field is evenly distributed, strength loss is reduced, and the pulsed magnetic field intensity and distribution in manufacturing can meet the requirements. In addition, the split type magnetic yoke plate facilitates control of magnetic field distribution.

Through the combined action of the driving device 10 and the ultrasonic shot peening device 20, ultrasonic impact surface nanometer strengthening is achieved, a surface nano layer with a certain thickness is generated on an inner ring raceway of a bearing ring through ultrasonic shot peening, and therefore the surface hardness and abrasion resistance of the working surface of the bearing ring are improved, and the fatigue life of the working surface of the bearing ring is prolonged. Furthermore, targeted repair of micro-nano damage by virtue of the electric-magnetic composite field is realized through the combined action of the pulsed current generator and the magnet yoke-coil device. Wherein, the pulsed current field has the effects that the ultrasonic shot peening surface nanocrystallization increases the surface roughness to cause surface micro-cracks to be easily generated, which is very unfavorable for the fatigue life of the bearing, while the pulsed current can heal the surface micro-cracks and realize targeted repair. The pulsed magnetic field has the effects that dislocation is redistributed under the action of the pulsed magnetic field, so that the homogenization of the diffusion behaviors of elements in the material is promoted, the peak stress is relaxed, the residual stress is reduced, crack initiation is slowed down, and the fatigue life of the material is prolonged. The pulsed current and the pulsed magnetic field are simultaneously applied to the bearing inner ring to form an electric-magnetic composite field, the energy state of valence electrons is changed by externally applying the electric field and the magnetic field, then high-energy-state atoms are promoted to move to a new balance position, and the free energy of the system is reduced. The magnetic field provides power, the current plays a lubricating role, and the composite treatment by the coupled pulsed magnetic field and pulsed current has a gain effect on reducing the residual stress. The electric-magnetic composite field can improve microcosmic non-uniformity, homogenize deformation, phase change and internal energy distribution, repair damage defects in situ and strengthen a weak structure property area in a targeted manner on the basis of ultrasonic impact surface strengthening, the problem of matrix micro-nano scale damage defect control in macroscale manufacturing is solved, and the fatigue life of an existing aeroengine bearing is further prolonged.

According to further optimization, the driving device 10 is integrally installed on a first lifting frame, and the gap between the bearing inner ring 30 and the opening in the upper end of the ultrasonic shot peening cavity 21 is adjusted through the first lifting frame, so that not only can tight clearance fit between the bearing inner ring 30 and the ultrasonic shot peening cavity 21 be guaranteed, but also the bearing inner ring 30 can rotate at a high speed without interference.

According to further optimization, for bearings made of different materials, ultrasonic shot peening parameters are different, especially shot peening distances, namely the distance between the upper top surface of the ultrasonic probe 22 and the lowest point of the raceway cambered surface of the bearing inner ring 30, and the surface nanometer strengthening effects are different. Therefore, the ultrasonic shot peening cavity 21 is installed on a fixing support, the ultrasonic probe 22 is installed on a second lifting frame, and the distance between the upper surface of the ultrasonic probe 22 and the raceway of the bearing inner ring 30 is adjusted through the second lifting frame, so that the shot peening distance is controllable, and the optimal surface nanometer strengthening effect is achieved.

According to further optimization, the opening in the upper end of the ultrasonic shot peening cavity 21 is designed to be in the shape of a cambered surface 211 matched with the radian of the raceway of the bearing inner ring 30, as shown in FIG. 3, so that the raceway of the bearing inner ring 30 is in tight fit with the ultrasonic shot peening cavity 21, so as to prevent the steel balls 23 from being sputtered out in the impact process.

According to further optimization, the driving device 10 further comprises a fixed cover plate 16 and a detachable cover plate 17. The fixed cover plate 16 is fixedly installed on the rotating shaft 12, the bearing inner ring 30 to be machined is installed between the two cover plates, and the detachable cover plate 17 is connected to the fixed cover plate 16 in a fastened mode through bolts so as to achieve fixation of the bearing inner ring 30 and prevent the bearing inner ring 30 from axially moving along the rotating shaft 12.

According to further optimization, the ultrasonic shot peening device 20 further comprises an ultrasonic transducer, an amplitude-change pole and an ultrasonic generator. The ultrasonic transducer is located below an ultrasonic spray head and connected to the ultrasonic spray head through the amplitude-change pole, and the ultrasonic generator is connected to the ultrasonic transducer through a cable.

According to further optimization, the ultrasonic shot peening device 20 adopts high-frequency ultrasonic waves with a frequency of 20 KHz-10000 KHz.

According to further optimization, the diameter of the steel ball 23 is 0.1 mm-10 mm, and the number of the steel balls 23 is 10-1000.

According to further optimization, the ultrasonic treatment time is 10 s-1200 s.

According to further optimization, the rotating speed of the motor 11 is 100 rmp-100000 rmp.

According to further optimization, in order to achieve high-speed rotation, a left supporting bearing pedestal 14 and a right supporting bearing pedestal 15 are arranged on the two sides of the bearing inner ring 30 respectively, a high-speed bearing is installed in the two supporting bearing pedestals, the rotating shaft 12 penetrates through the high-speed bearing, and interference-free high-speed rotation can be achieved.

By taking a deep groove ball bearing inner ring as an example, the distance between the bearing inner ring 30 and the cambered surface of the ultrasonic shot peening cavity 21 is kept to be 0.5 mm, good clearance fit is achieved, and the bearing inner ring 30 can rotate stably without interference. The surface of the ultrasonic probe 22 is covered with steel balls 23 with the diameter of 3 mm, the ultrasonic probe 22 is fed into the ultrasonic shot peening cavity 21, and the distance between the surface of the ultrasonic probe 22 and a raceway of the bearing inner ring 30 is controlled to be about 10 mm. The bearing inner ring 30 is driven by the motor 11 to rotate at a constant speed, the plane of the bearing inner ring 30 is perpendicular to the plane of the ultrasonic probe 22, the ultrasonic probe 22 generates high-frequency vibration to endow the 3-mm steel balls 23 on the ultrasonic probe 22 with high-frequency and high-speed impact energy for ultrasonic shot peening, and the average energy of impacting the surface of a material by a single shot following the trend is $10^{-4}$-$10^{3}$ J. Shot peening enables the bearing raceway to generate severe plastic deformation, resulting in the increase of the dislocation density, grain refinement and the formation of a nanometer strengthening layer.

The device for targeted repair of micro-nano damage of an inner ring of an aeroengine bearing by virtue of an electric-magnetic composite field has two process above solutions, namely a process of targeted repair of micro-nano damage by virtue of the electric-magnetic composite field during the ultrasonic impact process and a process of targeted repair of micro-nano damage by virtue of the electric-magnetic composite field after the ultrasonic impact process.

Figure 4:
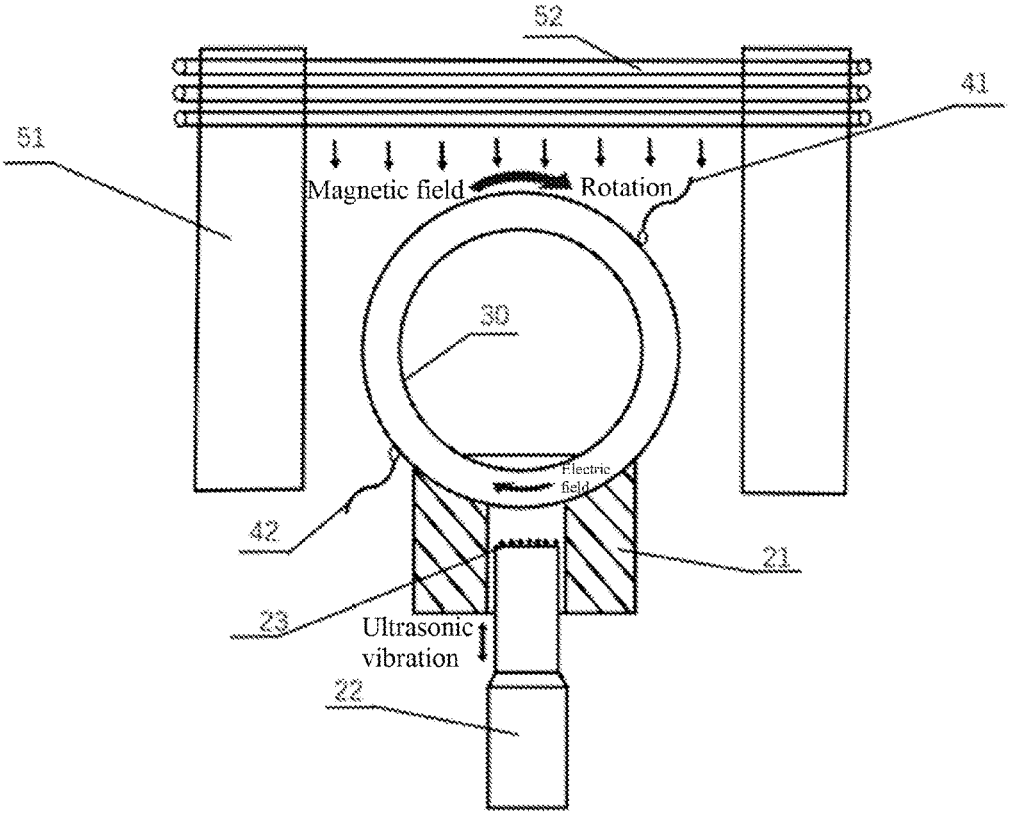
FIG. 4 is a process schematic diagram of a first repair method of the device.

When the electric-magnetic composite field is applied in the ultrasonic impact surface nano-strengthening process, an in-situ targeted repair effect is achieved, as shown in FIG. 4. The method specifically comprises the following steps:

S1. Preparing a driving device 10 and an ultrasonic shot peening device 20 which are matched with a selected aeroengine bearing according to the model of the selected aeroengine bearing, and preparing a pulsed current generator and a set of magnet yoke-coil device.

S2. Installation and adjustment of equipment: installing an ultrasonic shot peening cavity 21 on a fixing support, then integrally installing the driving device 10 on a first lifting frame, and enabling an opening in the upper end of the ultrasonic shot peening cavity 21 to be located right below a bearing inner ring 30. Finally, installing an ultrasonic probe 22 on a second lifting frame, covering the surface of the ultrasonic probe 22 with steel balls 23, and feeding the ultrasonic probe 22 into the ultrasonic shot peening cavity 21. Adjusting a gap between the bearing inner ring 30 and the opening in the upper end of the ultrasonic shot peening cavity 21 to a set value through the first lifting frame, and adjusting the distance between the upper surface of the ultrasonic probe 22 and a raceway of the bearing inner ring 30 to a set value through the second lifting frame.

Winding a current-carrying coil 52 around magnet yoke plates 51, and then enabling the magnet yoke plates 51 around which the current-carrying coil 52 is wound to cover the bearing inner ring 30 needing shot peening.

Enabling an input-end contact 41 and an output-end contact 42 of the pulsed current generator to be in contact with two ends of the bearing inner ring 30 respectively, and forming a loop by taking the bearing inner ring 30 as a conductor.

S3. Electrifying the current-carrying coil 52 to excite a magnetic field, and electrifying the pulsed current generator to generate pulsed current on the bearing inner ring 30 to excite an electric field. Then, starting the motor 11 to enable the bearing inner ring 30 to rotate, and starting the ultrasonic shot peening device 20 to enable the ultrasonic probe 22 to generate high-frequency vibration to excite the steel balls 23 in the ultrasonic shot peening cavity 21 to impact the surface of the raceway of the bearing inner ring 30 at a high speed.

S4. Performing technologies such as electrolytic polishing and finishing on the surface of the bearing raceway after ultrasonic impact, so as to meet the requirement on the surface roughness of the bearing raceway under the actual working condition.

According to a process of targeted repair of micro-nano damage by virtue of the electric-magnetic composite field during the ultrasonic impact process, the electric-magnetic composite field is applied in the ultrasonic impact surface nanocrystallization process, and the formed in-situ surface micro-nano damage is repaired, so that the deformation, phase change and internal energy distribution of a nano layer are homogenized. The method solves the problem of matrix micro-nano scale damage defect control in macroscale manufacturing, and breaks through the service performance and service life limits of the existing aeroengine bearing.

Figure 5:
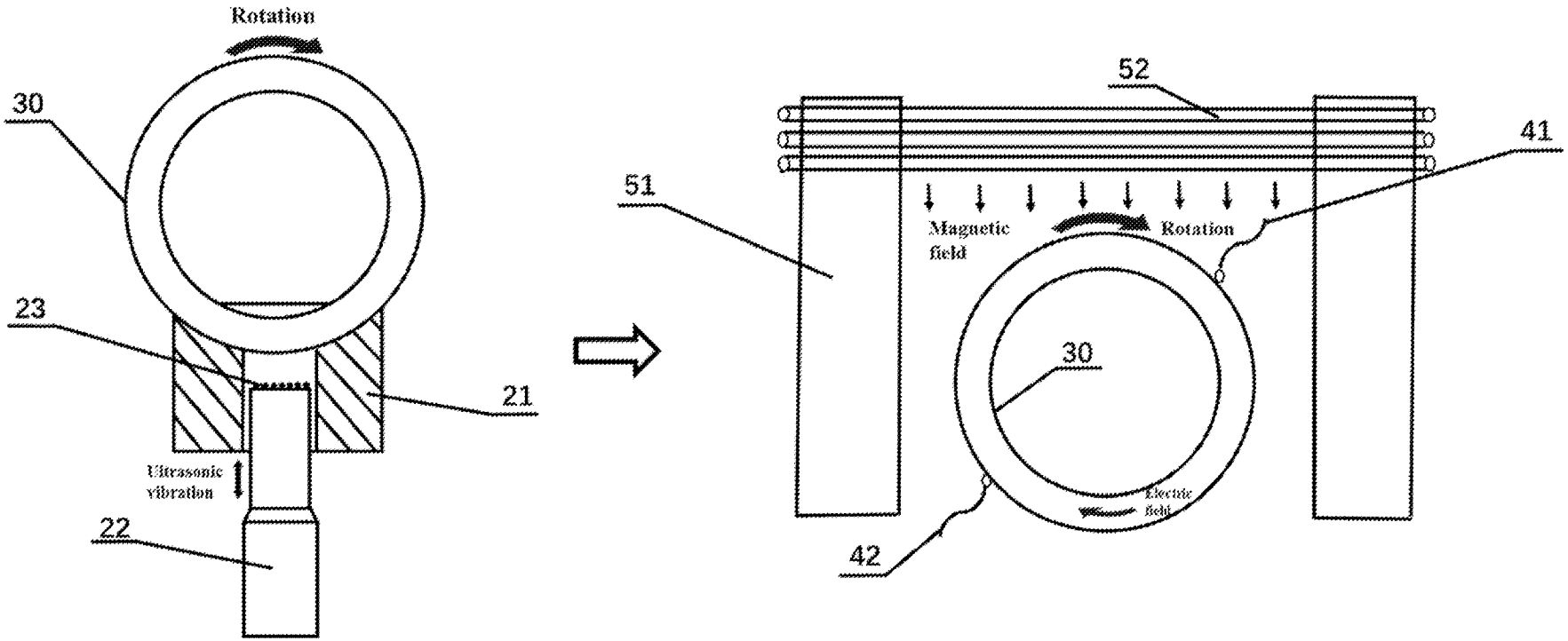
FIG. 5 is a process schematic diagram of a second repair method of the device.

When the electric-magnetic composite field is applied after the ultrasonic impact surface nanometer strengthening, an effect of targeted repair after forming and manufacturing is achieved, as shown in FIG. 5. The method specifically comprises the following steps:

S1. Preparing a driving device 10 and an ultrasonic shot peening device 20 which are matched with a selected aeroengine bearing according to the model of the selected aeroengine bearing.

S2. Installation and adjustment of equipment: installing an ultrasonic shot peening cavity 21 on a fixing support, then integrally installing the driving device 10 on a first lifting frame, and enabling an opening in the upper end of the ultrasonic shot peening cavity 21 to be located right below the bearing inner ring 30. Finally, installing an ultrasonic probe 22 on a second lifting frame, covering the surface of the ultrasonic probe 22 with steel balls 23, and feeding the ultrasonic probe 22 into the ultrasonic shot peening cavity 21. Adjusting a gap between the bearing inner ring 30 and the opening in the upper end of the ultrasonic shot peening cavity 21 to a set value through the first lifting frame, and adjusting the distance between the upper surface of the ultrasonic probe 22 and a raceway of the bearing inner ring 30 to a set value through the second lifting frame.

Winding a current-carrying coil 52 around magnet yoke plates 51, and then enabling the magnet yoke plates 51 around which the current-carrying coil 52 is wound to cover the bearing inner ring 30 needing shot peening.

Enabling an input-end contact 41 and an output-end contact 42 of the pulsed current generator to be in contact with two ends of the bearing inner ring 30 respectively, and forming a loop by taking the bearing inner ring 30 as a conductor.

S3. Separately starting the ultrasonic probe 22 and a motor 11, adopting high-frequency ultrasonic waves to drive the steel balls 23 to impact the surface of the raceway of the aeroengine bearing inner ring 30 to enable severe plastic deformation to be generated on the surface of the raceway of the aeroengine bearing inner ring 30, so as to realize nanometer strengthening of the surface of the raceway of the aeroengine bearing.

S4. Closing the ultrasonic probe 22, stopping ultrasonic shot peening, and keeping the bearing inner ring 30 rotating; then electrifying the current-carrying coil 52 to excite a magnetic field, electrifying the pulsed current generator to generate pulsed current on the bearing inner ring 30 to excite an electric field, and performing targeted repair on the micro-nano damage of the bearing inner ring 30 under the action of the electric-magnetic composite field.

S5. Performing technologies such as electrolytic polishing and finishing on the surface of the bearing raceway after repair by virtue of the electric-magnetic composite field, so as to meet the requirement on the surface roughness of the bearing raceway under the actual working condition.

According to a process of targeted repair of micro-nano damage by virtue of the electric-magnetic composite field after the ultrasonic impact process, the electric-magnetic composite field is applied after the ultrasonic impact surface nanocrystallization process, and the formed in-situ surface micro-nano damage is repaired, so that the deformation, phase change and internal energy distribution of a nano layer are homogenized. The method solves the problem of matrix micro-nano scale damage defect control in macroscale manufacturing, and breaks through the service performance and service life limits of the existing aeroengine bearing.

The repair effects of the two process solutions are not greatly different, and if the bearing is large and is not easily assembled on the first process device, then the second manufacturing and repair separated process is applied, so that the bearing is easy to assemble. If the bearing can be assembled on the first process device, then the first manufacturing and repair combined process is applied, so that the time can be saved and the efficiency can be improved.

The novel technology of ultrasonic impact surface nanometer strengthening by virtue of electric-magnetic composite field is suitable for various metal materials such as aluminum alloy, titanium alloy, stainless steel, nickel-based alloy and carbon steel.

The novel technology of ultrasonic impact surface nanometer strengthening by virtue of electric-magnetic composite field is suitable for strengthening inner ring raceways and matrixes of various bearings such as rolling bearings and sliding bearings.

The technology of ultrasonic impact surface nanometer strengthening by virtue of electric-magnetic composite field can be popularized to surface and matrix structure property strengthening and service life prolonging of other mechanical parts such as motor shafts, gears and blades.

Embodiments in the description are described in a progressive mode, each embodiment focuses on differences from other embodiments, and the same and similar parts of the embodiments can be referred to mutually.

The embodiments of the present invention have been described in combination with the accompanying drawings, but the method is not limited to the specific implementations, the specific implementations are only schematic rather than restrictive, and those of ordinary skill in the art can make various forms under the enlightenment of the method without departing from the purpose and the protection range of the claims of the present invention, and all the forms belong to the protection range of the present invention.

What is claimed is:

1. A device for targeted repair of micro-nano damage of an inner ring of an aeroengine bearing based on an electric-magnetic composite field, the device comprising a driving device, an ultrasonic shot peening device, a pulsed current generator and a magnet yoke-coil device, wherein:

the driving device comprises a motor and a rotating shaft, the rotating shaft is configured for fixedly installing a bearing inner ring to be machined, and an output shaft of the motor is connected to the rotating shaft and drives the rotating shaft to drive the bearing inner ring to rotate synchronously; the ultrasonic shot peening device comprises an ultrasonic shot peening cavity, an ultrasonic probe and steel balls, openings are respectively formed in an upper end and a lower end of the ultrasonic shot peening cavity, the ultrasonic probe extends into the ultrasonic shot peening cavity from the opening in the lower end of the ultrasonic shot peening cavity, and the steel balls are placed on the ultrasonic probe and cover an upper surface of the ultrasonic probe; the opening in the upper end of the ultrasonic shot peening cavity is placed below and in clearance fit with the bearing inner ring to be machined; ultrasonic impact surface nanometer strengthening is able to be carried out on the bearing inner ring by separately starting the ultrasonic probe and the motor;

an input-end contact and an output-end contact of the pulsed current generator are in contact with two ends of the bearing inner ring respectively and are configured for generating pulsed current on the bearing inner ring to excite an electric field;

the magnet yoke-coil device comprises a magnet yoke plate and a current-carrying coil wound around the magnet yoke plate, the magnet yoke plate is installed on a side of the bearing inner ring, and the current-carrying coil is configured for being connected with the pulsed current so as to excite a magnetic field around the bearing inner ring, wherein a rotation axis of the bearing inner ring is perpendicular to a direction of the magnetic field and a direction of electric field.

2. The device for targeted repair of micro-nano damage of an inner ring of an aeroengine bearing based on an electric-magnetic composite field according to claim 1, wherein the driving device is integrally installed on a first lifting frame, and a gap between the bearing inner ring and the opening in the upper end of the ultrasonic shot peening cavity is adjusted through the first lifting frame.

3. The device for targeted repair of micro-nano damage of an inner ring of an aeroengine bearing based on an electric-magnetic composite field according to claim 1, wherein the ultrasonic shot peening cavity is installed on a fixing support, the ultrasonic probe is installed on a second lifting frame, and a distance between the upper surface of the ultrasonic probe and a raceway of the bearing inner ring is adjusted through the second lifting frame.

4. The device for targeted repair of micro-nano damage of an inner ring of an aeroengine bearing based on an electric-magnetic composite field according to claim 1, wherein the opening in the upper end of the ultrasonic shot peening cavity is designed to be in a cambered surface shape matched with a radian of the raceway of the bearing inner ring, so that the raceway of the bearing inner ring is tightly fitted for the ultrasonic shot peening cavity to prevent the steel balls from being sputtered out in an impact process.

5. The device for targeted repair of micro-nano damage of an inner ring of an aeroengine bearing based on an electric-magnetic composite field according to claim 1, wherein a number of the magnet yoke plates is two, the two magnet yoke plates are respectively arranged on two sides of the bearing inner ring in parallel so as to cover the bearing inner ring, and the current-carrying coil is wound around the two magnet yoke plates and located above the bearing inner ring.

6. The device for targeted repair of micro-nano damage of an inner ring of an aeroengine bearing based on an electric-magnetic composite field according to claim 1, wherein the ultrasonic shot peening device adopts high-frequency ultrasonic waves with a frequency of 20 KHz-10000 KHz; a diameter of the steel ball is 0.1 mm-10 mm, and a number of the steel balls is 10-1000, and an ultrasonic treatment time is 10s-1200s.

7. The device for targeted repair of micro-nano damage of an inner ring of an aeroengine bearing based on an electric-magnetic composite field according to claim 1, wherein an electric pulse intensity range of the pulsed current generator is $1\text{-}10^6$ A/cm$^2$.

8. The device for targeted repair of micro-nano damage of an inner ring of an aeroengine bearing based on an electric-magnetic composite field according to claim 1, wherein a magnetic pulse intensity range of the magnet yoke-coil device is 0.01-100 Tesla.

9. A method for targeted repair of micro-nano damage of an aeroengine bearing based on an electric-magnetic composite field, wherein the method is carried out by adopting the device according to claim 1, and comprises the following steps:

S1, preparing the driving device and the ultrasonic shot peening device which are matched with a selected aeroengine bearing according to a model of the selected aeroengine bearing, and preparing the pulsed current generator and a set of the magnet yoke-coil device;

S2, installation and adjustment of equipment: installing the ultrasonic shot peening cavity on a fixing support, then integrally installing the driving device on a first lifting frame, and enabling the opening in the upper end of the ultrasonic shot peening cavity to be located right below the bearing inner ring; finally, installing the ultrasonic probe on a second lifting frame, covering the upper surface of the ultrasonic probe with steel balls, and feeding the ultrasonic probe into the ultrasonic shot peening cavity; adjusting a gap between the bearing inner ring and the opening in the upper end of the ultrasonic shot peening cavity to a set value through the first lifting frame, and adjusting a distance between the upper surface of the ultrasonic probe and a raceway of the bearing inner ring to a set value through the second lifting frame;

winding the current-carrying coil around the magnet yoke plates, and then enabling the magnet yoke plates around which the current-carrying coil is wound to cover the bearing inner ring needing shot peening;

enabling the input-end contact and the output-end contact of the pulsed current generator to be in contact with the two ends of the bearing inner ring respectively, and forming a loop by taking the bearing inner ring as a conductor; and S3, electrifying the current-carrying coil to excite the magnetic field; electrifying the pulsed current generator to generate the pulsed current on the bearing inner ring to excite an electric field; then starting the motor to enable the bearing inner ring to rotate, and starting the ultrasonic shot peening device to enable the ultrasonic probe to generate high-frequency vibration to excite the steel balls in the ultrasonic shot peening cavity to impact a surface of the raceway of the bearing inner ring at a higher speed.

10. A method for targeted repair of micro-nano damage of an aeroengine bearing based on an electric-magnetic composite field, wherein the method is carried out by adopting the device according to claim 1, and comprises the following steps:

S1, preparing the driving device and the ultrasonic shot peening device which are matched with a selected aeroengine bearing according to a model of the selected aeroengine bearing, and preparing the pulsed current generator and a set of the magnet yoke-coil device;

S2, installation and adjustment of equipment: installing the ultrasonic shot peening cavity on a fixing support, then integrally installing the driving device on a first lifting frame, and enabling the opening in the upper end of the ultrasonic shot peening cavity to be located right below the bearing inner ring; finally, installing the ultrasonic probe on a second lifting frame, covering the upper surface of the ultrasonic probe with steel balls, and feeding the ultrasonic probe into the ultrasonic shot peening cavity; adjusting a gap between the bearing inner ring and the opening in the upper end of the ultrasonic shot peening cavity to a set value through the first lifting frame, and adjusting a distance between the upper surface of the ultrasonic probe and a raceway of the bearing inner ring to a set value through the second lifting frame;

winding the current-carrying coil around the magnet yoke plates, and then enabling the magnet yoke plates around which the current-carrying coil is wound to cover the bearing inner ring needing shot peening;

enabling the input-end contact and the output-end contact of the pulsed current generator to be in contact with the two ends of the bearing inner ring respectively, and forming a loop by taking the bearing inner ring as a conductor;

S3, starting the motor to enable the bearing inner ring to rotate, and starting the ultrasonic shot peening device to enable the ultrasonic probe to generate high-frequency vibration to excite the steel balls in the ultrasonic shot peening cavity to impact a surface of the raceway of the bearing inner ring at a higher speed to enable severe plastic deformation to be generated on the surface of the raceway of the aeroengine bearing inner ring, so that the surface of the raceway of the aeroengine bearing is nano-strengthened; and S4, closing the ultrasonic probe, stopping ultrasonic shot peening, and keeping the bearing inner ring rotating; then electrifying the current-carrying coil to excite the magnetic field; electrifying the pulsed current generator to generate the pulsed current on the bearing inner ring to excite an electric field; and performing targeted repair on the micro-nano damage of the bearing inner ring under an action of the electric-magnetic composite field.

* * * * *